US005772545A

United States Patent [19]

Ou

[11] Patent Number: 5,772,545

[45] Date of Patent: Jun. 30, 1998

[54] SPORTSBALL AND MANUFACTURING METHOD THEREOF

[76] Inventor: Tsung Ming Ou, No. 32, Lane 56, Chung Cheng 2nd Road, Kaohsiung, Taiwan

[21] Appl. No.: 771,264

[22] Filed: Dec. 20, 1996

[51] Int. Cl.[6] ..... A63B 41/10; B65H 54/64

[52] U.S. Cl. ..... 473/605; 156/170

[58] Field of Search ..... 473/594, 595, 473/598, 599, 603, 604, 605, 607, 608, 609, 613; 273/DIG. 20; 156/170, 169, 171, 172

[56] References Cited

U.S. PATENT DOCUMENTS

| | | | |
|---|---|---|---|
| 2,789,821 | 4/1957 | Crowley | 473/605 |
| 3,655,197 | 4/1972 | Milbaum | 473/594 |
| 4,333,648 | 6/1982 | Aoyama | 156/170 |
| 4,462,590 | 7/1984 | Mitchell | 473/603 |
| 4,856,781 | 8/1989 | Shishido et al. | 473/603 |
| 5,597,432 | 1/1997 | Shishido et al. | 156/170 |
| 5,636,835 | 6/1997 | Schindler et al. | 473/605 |

*Primary Examiner*—Steven B. Wong

*Attorney, Agent, or Firm*—David & Raymond; Raymond Y. Chan

[57] ABSTRACT

A sportsball includes a ball cover and a bladder. The ball cover has a valve hole provided thereon and consists of a plurality of panels connected edge to edge by machine sewing to form a roundness shape. Each of the panels has a predetermined shape and is made of leather or synthetic leather, wherein the synthetic leather has an outer coating layer, an inner lining layer, and an intermediate layer which is integrally formed between the outer coating layer and the inner lining layer and is strengthened and supported by the inner lining layer. The bladder is disposed inside the ball cover and includes a rubber made bladder ball, an exterior web layer integrally adhered on an outer surface of the bladder ball, and a valve stem which is mounted on the bladder ball and is extended through the valve hole of the ball cover to connected thereto for air inflation. The web layer includes at least an elongating strengthened thread evenly wound around and around the outer surface of the bladder ball. Therefore, the strengthened thread is overlapped with each other to form the web layer to entirely embrace the bladder ball for supporting the ball cover and resisting the stress and impact force of the sportsball.

9 Claims, 5 Drawing Sheets

SPORTSBALL AND MANUFACTURING METHOD THEREOF

BACKGROUND OF THE PRESENT INVENTION

The present invention relates to sportsballs, and more particularly to a durable sportsball adapted for mass production, moreover the sportsball can retain its spherical shape and distribute the impacting stress throughout the ball.

Sportsball such as soccer ball and volleyball, as shown in FIGS. 1 and 2, generally comprises a ball cover 11 and a bladder 12 disposed within the ball cover 11. The ball cover 11 is made of leather or synthetic leather such as polyurethane (PU) or polyvinyl chloride (PVC). As shown in FIG. 2, the synthetic leather is composed of an outer coating layer 111 , an intermediate foaming layer 112 and an inner lining layer 113 to strengthen and support the foaming layer 112. The bladder 12 is a spherical rubber ball having a valve stem 121 affixed thereon.

The leather or synthetic leather is cut into a plurality of panels 110 with predetermined shape. For soccer ball, the most common shape of the panel 110 is pentagon and hexagon. In other words, the ball cover 11 of a soccer ball is made of 12 pieces of pentagonal panels and 20 pieces of hexagonal panels by hand sewing edge to edge. The spherical ball cover 11 of a volleyball consists of 18 pieces of rectangular panels hand sewn edge to edge. The inflatable bladder 12 is placed inside the ball cover 11 and its valve stem 121 is extended outside the ball cover 11 for air inflation. When air is pumped into the bladder 12 through the valve stem 121, the air inflates the bladder 12 to prop up the ball cover 11 and retain its roundness. Therefore, an inflated sportsball has a bouncing feature. The more air is inflated into the bladder 12, the sportsball has a better bounce.

The rigidity and durability of a conventional sportsball as described above merely depend on the structure of the ball cover 11 but not the soft rubber bladder 12. The structure of the ball cover 11 must be tough enough to absorb all the impact forces. Therefore, the panels 110, either made of leather or synthetic leather, must be further strengthened by affixing at least two more layers of coarse lining 114, 115 thereon in order to better support the ball cover 11 and resist the stress. The roundness and re-enforcement of the sportsball depend on the strength of the lining cloth. Hence, the material used for the lining cloth is very important, that it may increase the material cost of the conventional sportsballs. Basically, the additional linings 114, 115 are glued layer by layer on the inner lining layer 113 of the synthetic leather or the inner side of the leather before cutting into the panels 110, which increases a manufacturing adhesion step for the conventional sportsball.

However, the additional coarse linings 114, 115 not only increase the thickness of the ball cover 11, but also increase the hardness of the ball cover 11. Accordingly, the thick and hard panels 110 increase the difficulty of sewing the panels together by sewing machines, especially during sewing around the sharp comers of the panels 110, that is the weakest portion of the ball cover 11. It is the reason that why most of the formal or classic sportsballs are still hand made. The workers have to sew the panels 110 together one by one by hand. Normally, a skillful worker can only complete the sewing process of two sportsballs per a working day. It is extremely uneconomic and time consuming that would highly increase the manufacturing cost of the sportsballs.

Another serious shortcoming of the hand sewing sportsball is that it is nearly impossible to evenly sew the panels together under same tightness. Therefore, when the sportsball is inflated, the ball cover 11 would be propped by the bladder 12 to protrude outwardly at some less tightly constructed portions of the ball cover 11, so that the roundness of the sportsball is adversely affected. Moreover, the sewing threads may more easily be broken during heavy impact, so that thickened sewing threads should be used. In fact, no hand made sportsball is in absolutely spherical shape, that may affect the performance of the conventional sportsball. When the sportsball is hit on such protruded portion, it may not bounce to the desired direction. Besides, those weaker portions of the sportsball will more easily be worn out and those sewing threads at such portions may also more easily be broken.

Since the linings 114, 115 are made of cloth, they tend to stretch while the sportsball is hit. At that time, the sportsball would lose its spherical shape because of the lining stretching. Practically, the inflated bladder 12 is directly propped on the additional linings 114, 115, therefore the major stress supporting area of the sportsball is the connecting surface between the additional linings 114, 115 and the leather or synthetic leather of the ball cover 11. It is well known that the stress resisting ability and the durability of cloth material are poor. In other words, the additional linings 114, 115 are not strong enough to endure those inflating stress and impact stress, especially during the impacting of the sportsball. The additional linings 114, 115 will rip apart sooner or later that would cause the sportsball to be worn off and damaged.

Furthermore, the leather or the thickened and hardened synthetic leather ball cover 11 of the conventional soccer ball may make the soccer player feels hurt and pain during heading, especially to children and those training players. The volleyball which is constructed by such conventional ball cover 11 may also cause the volleyball player feels pain and uncomfortable during servicing, spiking and blocking. For children and training soccer players or volleyball players, such thickened and hardened ball cover 11 of the conventional sportsball would be too rigid and hard for them.

SUMMARY OF THE PRESENT INVENTION

It is an object of the present invention to provide a sportsball which ball cover is well supported by a strengthened bladder. Therefore, no additional lining is required to adhered onto the ball cover that, it can lower the material cost and manufacturing cost of the sportsball.

It is still an object of the present invention to provide a sportsball which major stress supporting portion is the strengthened bladder.

It is still an object of the present invention to provide a sportsball which bladder has a better flexibility and impact resisting ability.

It is still an object of the present invention to provide a sportsball which is more durable and has a softer ball cover to reduce the painful during heading, especially suitable for children and training players.

It is yet an object of the present invention to provide a sportsball which has a better roundness even when it is over-inflated for 15 to 20% more than the standard pressure.

It is yet an object of the present invention to provide a sportsball made of leather, in which since the stress supporting and impact resisting portion is the strengthened bladder, but not the ball cover, the expensive leather panels of the ball cover can be made thinner to lessen the cost, and that an additional soft sponge pad layer can be adhered on an inner surface of the leather panel to soften and reinforce the leather ball cover.

It is yet an object of the present invention to provide a manufacturing method of a sportsball which enables the ball cover to be sewn by sewing machine, and thus it is suitable for mass production.

Accordingly, a sportsball of the present invention includes a ball cover and a bladder. The ball cover has a valve hole provided thereon and consists of a plurality of panels connected edge to edge by machine sewing to form a roundness shape. Each of the panels has a predetermined shape and is made of synthetic leather, wherein the synthetic leather has an outer coating layer, an inner lining layer, and an intermediate layer which is integrally formed between the outer coating layer and the inner lining layer and is strengthened and supported by the inner lining layer. The bladder which is disposed inside the ball cover includes a rubber made bladder ball, an exterior web layer integrally attached on a predetermined area of an outer surface of the bladder ball, and a valve stem which is mounted on the bladder ball and is extended through the valve hole of the ball cover to connected thereto for air inflation. The web layer includes at least an elongated strengthened thread evenly wound around and around the outer surface of the bladder ball. Therefore, the strengthened thread is overlapped to form the web layer to entirely embrace the bladder ball for supporting the bladder ball and resisting the stress and impact force applied to the sportsball.

The panels of the ball cover can also be made of thin leather with a pad layer adhered underneath for providing the softness and thickness of the ball cover.

A specific manufacturing method is used to produce the sportsball of the present invention which comprises the following steps:

(1) Inflate a rubber bladder ball which has a valve stem provided thereon.

(2) Coat at least an elongated strengthened thread such as nylon threads with glue.

(3) Wind the nylon thread evenly around and around an outer surface of the rubber ladder ball until the bladder ball is embraced by a web layer of the nylon thread to form a strengthened bladder.

(4) Heat the bladder in a mold until the web layer is permanently and rigidly united with the outer surface of the bladder ball.

(5) Cut a ball cover material, such as leather or synthetic leather made of foaming PU or PVC sponge material, into a predetermined number of panels in predetermined shape. For soccer ball, 12 pieces of pentagonal panels and 20 pieces of hexagonal panels are cut. For volleyball, 18 pieces of panels in two kinds of rectangular shape are cut.

(6) Sew the panels edge to edge together by sewing machine to form a ball cover which has a valve hole provided thereon, wherein a section of the panels are not sewn together to form an inlet opening at this stage.

(7) Heat the ball cover and turn the ball cover right side out.

(8) Insert the strengthened bladder into the ball cover through the inlet opening.

(9) Align and glue the valve stem of the bladder with the valve hole of the ball cover.

(10) Semi-inflate the bladder to make sure that the inflated bladder would prop against the ball cover.

(11) Sew the inlet opening of the ball cover together by hand.

(12) Fully inflate the sportsball to more than a standard pressure within a shaping mold to ensure a permanent structure and shape of the bladder and ball cover.

DETAILED DESCRIPTION OF THE PREFERRED EMBODIMENTS

Figure 1:
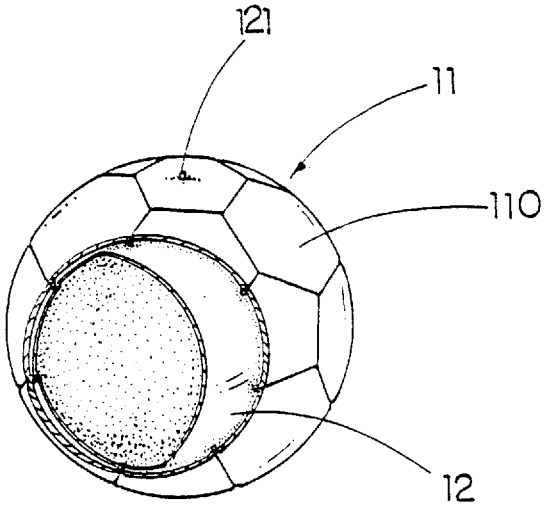
FIG. 1 PRIOR ART
FIG. 1 is a sectional perspective view of a conventional sportsball.
Figure 2:
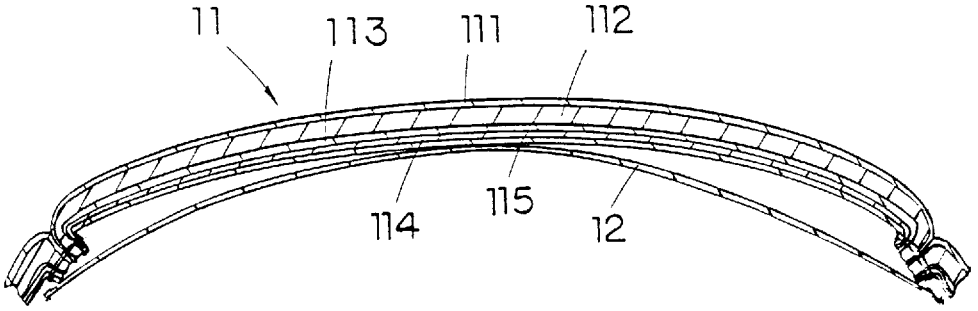
FIG. 2 PRIOR ART
FIG. 2 is a partial enlarged sectional view of a conventional sportsball.
Figure 3A:
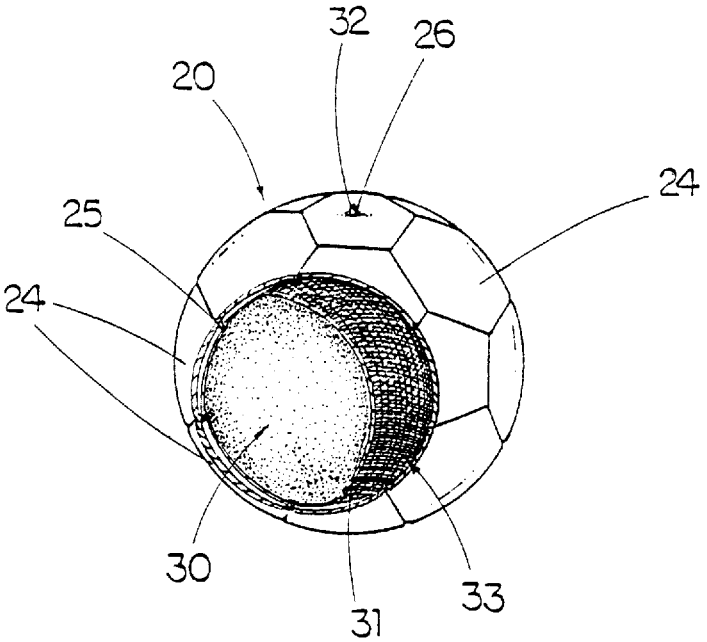
FIG. 3A is a sectional perspective view of a sportsball which is a soccer ball according to a first preferred embodiment of the present invention.
Figure 3B:
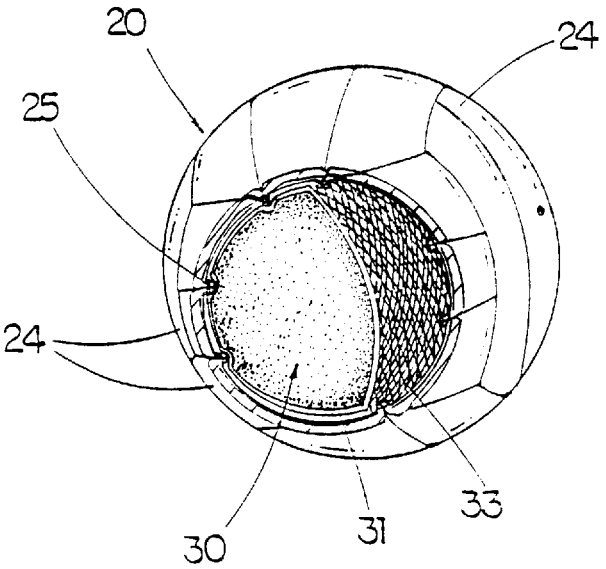
FIG. 3B is a sectional perspective view of a sportsball which is a volleyball according to a first preferred embodiment of the present invention.
Figure 4:
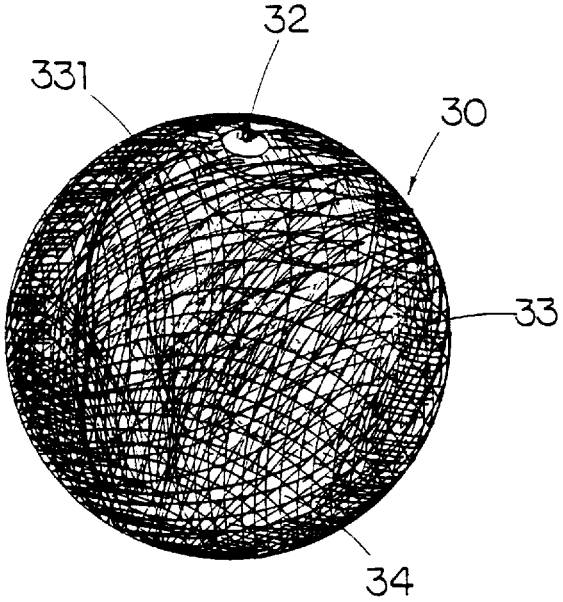
FIG. 4 is a perspective view of the strengthened bladder of the sportsball according to the above first preferred embodiment of the present invention.
Figure 5:
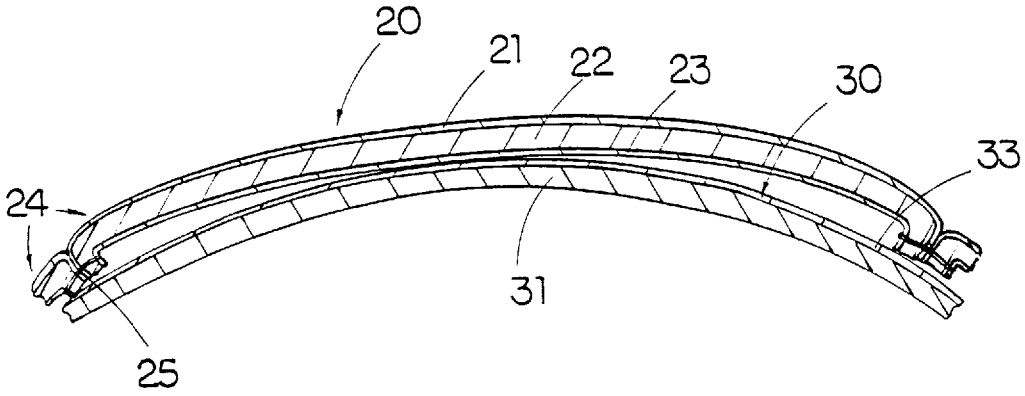
FIG. 5 is a partial enlarged sectional view of the sportsball according to the above first preferred embodiment of the present invention.

Referring to FIGS. 3 to 4, a sportsball having improved structure according to a first preferred embodiment of the present invention is illustrated. The sportsball, which is a soccer ball as shown in FIG. 3A or a volleyball as shown in FIG. 3B, comprises a ball cover 20 and a strengthened bladder 30 disposed within the ball cover 20. The ball cover 20 is made of leather or synthetic leather such as polyurethane (PU) or polyvinyl chloride (PVC). As shown in FIG. 5, the synthetic leather is composed of an outer coating layer 21, an intermediate layer 22 and an inner lining layer 23 to strengthen and support the intermediate layer 22.

The leather or synthetic leather is cut into a plurality of panels 24 with predetermined shape. For soccer ball, the most common shape of the panel 24 is pentagon and hexagon. In other words, the ball cover 20 of a soccer ball is made of 12 pieces of pentagonal panel and 20 pieces of hexagonal panel sewn edge to edge by sewing threads 25. The spherical ball cover 20 of a volleyball consists of 18 pieces of rectangular panel sewn edge to edge with sewing threads 25. The ball cover 20 has a valve hole 26 provided thereon.

The inflatable bladder 30, which is disposed inside the ball cover 20, comprises a rubber made bladder ball 31 and a valve stem 32 mounted thereon and extended through the valve hole 26 of the ball cover 20 to connected thereto for air inflation. In accordance with the present invention, the bladder 30 further comprises an exterior web layer 33 integrally attached on an outer surface of the bladder ball 31. As shown in FIG. 4, the bladder ball 31 is entirely embraced by the web layer 33. The web layer 33 comprises at least an elongating strengthened thread 331 (usually a plurality of strengthened threads 331 being applied), such as nylon threads, evenly wound around and around the outer surface of the bladder ball 31, therefore the strengthened thread 331 is overlapped with each other to form the web layer 33.

In order to enable the strengthened thread 331 being permanently affixed on the outer surface of the bladder ball 31, before winding onto the bladder ball 31, the strengthened thread 331 are coated with glue for adhering to the outer surface of the bladder ball 31 and each other. Moreover, the bladder ball 31 with the adhering strengthened thread 331 thereon are together cured by heating in a mold, so that the adhering strengthened threads 331 will be hardened to form the web layer 33 which is permanently united with the rubber bladder ball 31 integrally.

Due to the presence of the valve stem 32 on the bladder 30, the sportsballl may lose balance when it is flowing in air, i.e. the sportsball would fall down with the valve stem 32 always directing downwards. In order to ensure a better balance for the sportsball, as shown in FIG. 4, a rubber pad 34 having the same weight of the valve stem 32 is further integrally adhered to an end, which is opposite to the valve stem 32, of the bladder 30 in order to symmetrically balance the weight of the bladder 30.

Just like the fishing net structure or the spider web structure, web structure is one of the most strengthened and rigid constructions, that can support high stress and resist high impact force. Thus, the web layer 33 highly reinforces the soft and weak rubber bladder ball 31. In other words, the bladder 30 of the present invention is strengthened by the web layer 33 and has a better flexibility and impact resisting ability.

When air is pumped into the bladder 30 through the valve stem 32, the air inflates the bladder 30 to prop up the ball cover 20, as shown in FIG. 3. According to the present invention, the strengthened bladder 30 can support and retain the ball cover 20 in the desire roundness even though the bladder 30 is over-inflated up to 15–20% more than the standard pressure of the sportsball. Moreover, the supporting force of the bladder 30 applied to the ball cover is evenly distributed, so that the sportsball can has an even roundness to fulfill most players' desire.

An essential feature of the present invention is that, the web layer 33 of the bladder 30 not only strengthens the bladder ball 31, but also provides a reinforced supporting to the ball cover 20. Therefore, the major stress supporting area of the sportsball is the strengthened bladder 30 which is strong enough to resist and absorb most of the impact force. The sewing threads 25 of the ball cover 20 become more durable and would not be over-stress by overinflation, and thus the sportsball is more durable and has a longer life span. The additional supporting linings of the conventional ball cover can thus be eliminated. The synthetic leather of each panel 24 of the ball cover 20 of the present invention does not need to adhere those additional linings. Accordingly, the thickness and the hardness of the conventional synthetic leather panels are reduced. In other words, the panels 24 of the ball cover 20 of the present invention is softer that enables the manufacturer to utilize thinner sewing threads 25 to sew the panels together by means of the sewing machines. For a skilled sewing machine worker, he or she can complete the sewing process of 50 sportsballs in average within one working day. The manufacturing cost and time can thus be greatly reduced. The softer ball cover 20 structure of the present invention provides a cushion effect that can reduce the painful during heading for soccer players or during spiking for volleyball players, especially suitable for the children and training players.

Figure 6:
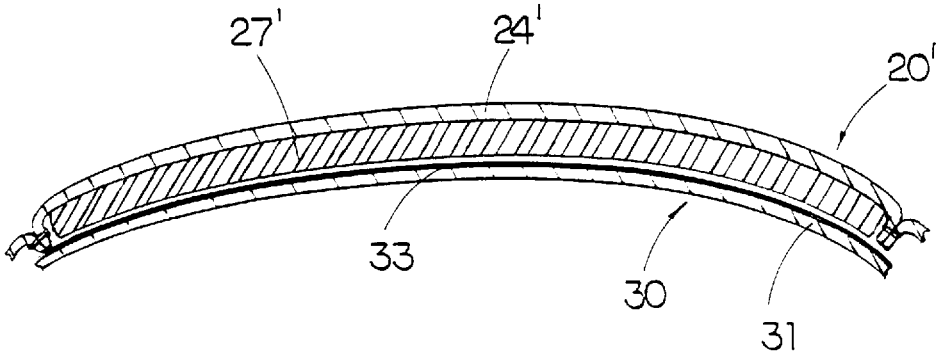
FIG. 6 is a partial enlarged sectional view of a leather sportsball according to a second preferred embodiment of the present invention.

In view of the conventional leather made sportsball, the panels are all made of thickened leather in order to resist the stress and impact force of the sportsball. Those leather panels are thick and hard, so that the leather panels must mostly be sewn by hand. Referring to FIG. 6, a second embodiment of a leather made sportsball is illustrated. The leather sportsball also comprises a strengthened bladder 30 as specified in the above first embodiment and a leather ball cover 20' which is made of a plurality of leather panels 24'. Due to the stress and impact force resisting features of the strengthened bladder 30 of the present invention, the leather panels 24' can be made thinner which is adapted to be sewn by sewing machine. Each panel 24' of the ball cover 20' further comprises a pad layer 27' adhered underneath the panel 24'. The pad layers 27' can be made of EVA or foaming PU or PVC to increases the overall thickness and softness of the panels 24' of the ball cover 20', so that all objectives of the present invention can also be achieved.

Figure 7:
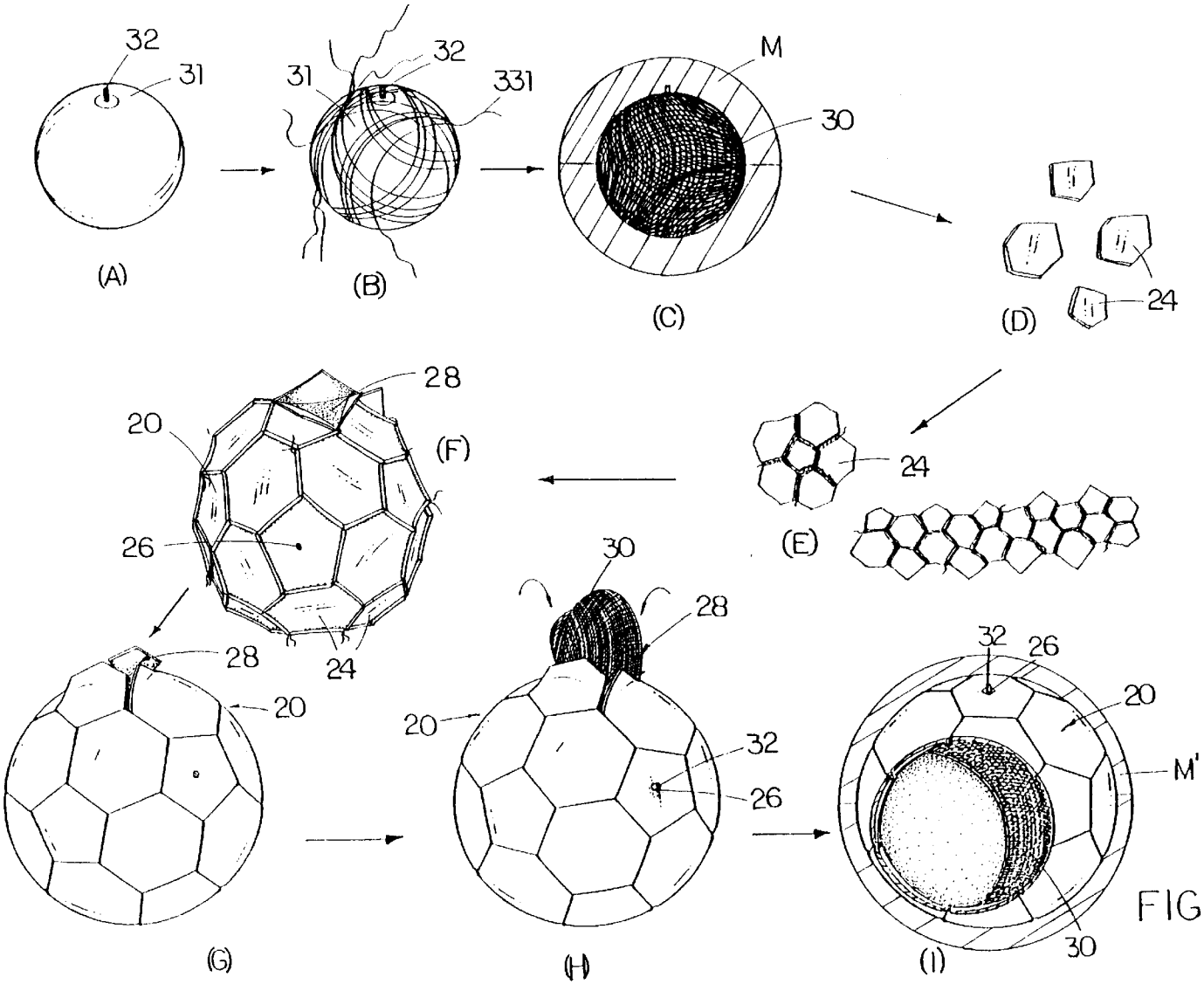
FIG. 7 is a illustrating diagram of a manufacturing method of the sportsball of the present invention.

A specific manufacturing method is used to produce the sportsball of the present invention, as illustrated in FIG. 7, which comprises the following steps:

(1) Inflate a rubber bladder ball 31 which has a valve stem 32 provided thereon, as shown in FIG. 7A.

(2) Coat at least an elongating strengthened threads such as nylon thread 331 with glue.

(3) Wind the nylon thread 331 evenly around and around an outer surface of the rubber bladder ball 31, as shown in FIG. 7B, until the bladder ball 31 is embraced by a web layer 33 of the nylon thread 331 to formna bladder 30, as shown in FIG. 7C.

(4) Heat the inflated bladder 30 in a mold M until the web layer 33 is permanently and rigidly united with the outer surface of the bladder ball 31.

(5) Cut a ball cover material, such as leather or synthetic leather made of foaming PU or PVC sponge material, into a predetermined number of panels 24 in predetermined shape, as shown in FIG. 7D. For soccer ball, 12 pieces of pentagonal panel and 20 pieces of hexagonal panels are cut. For volleyball, 18 pieces of panel in two kinds of rectangular shape are cut.

(6) Sew the panels 24 edge to edge together by sewing machine to form a ball cover 20 which has a valve hole 26 provided thereon, wherein a section of the panels 24 are not sewn together to form an inlet opening 28 at this stage, as shown in FIGS. 7E and 7F.

(7) Heat the ball cover 20 and turn the ball cover 20 right side out, as shown in FIG. 7G.

(8) Insert the strengthened bladder 30 into the ball cover 20 through the inlet opening 28, as shown in FIG. 7H.

(9) Align and glue the valve stem 32 of the bladder 30 with the valve hole 26 of the ball cover 20, as shown in FIG. 7H.

(10) Semi-inflate the bladder 30 to make sure that the bladder 30 can prop against the ball cover 20, as shown in FIG. 7H.

(11) Sew the inlet opening 28 of the ball cover 20 together by hand to form the sportsball, as shown in FIG. 7I.

(12) Fully inflate the sportsball to more than a standard pressure within a shaping mold M' to ensure a permanent structure and shape of the bladder 30 and the ball cover 20, as shown in FIG. 7I.

As specified above, the valve stem 32 on the bladder 30 may cause the sportsball losing balance when it is flowing in air, i.e. the sportsball would fall down with the valve stem 32 always directing downwards. The following step can be applied after the above step (3) in order to ensure a better balance for the sportsball:

(a) Adhere a rubber pad 34 having the same weight of the valve stem 32 integrally to an end, which is opposite to the valve stem 32, of the bladder 30 in order to symmetrically balance the weight of the bladder 30.

In accordance with the above described embodiments, the improved sportsball manufactured by the above method provides various remarkable features as follows.

The ball cover 20 of the sportsball is well supported by the strengthened bladder 30. Therefore, no additional lining is required to adhered onto the ball cover 20 that, it can lower the material cost and manufacturing cost of the sportsball.

The major stress supporting portion of the improved sportsball is the strengthened bladder 30 which has a better flexibility and impact resisting ability. Therefore, the sportsball is more durable, and that the ball cover 20 can reduce the painful during heading, especially suitable for children and training players.

The improved sportsball of the present invention has a better roundness even when it is over-inflated for 15 to 20% more than the standard pressure.

Even though the improved sportsball is made of leather, since the stress supporting And impact resisting portion is the strengthened bladder, but not the ball cover, the expensive leather panels of the ball cover can be made thinner to lessen the cost, and that an additional soft sponge pad layer can be adhered on an inner surface of the leather panel to soften and reinforce the leather ball cover.

According to the improved structure of the sportsball, the ball cover 20 is able to be to be sewn by sewing machine, and thus it is suitable for mass production.

I claim:

1. A manufacturing method of a sportsball, comprising the steps of:

(a) inflating a rubber bladder ball which has a valve stem provided thereon;

(b) coating at least an elongating strengthened thread with glue;

(c) winding said strengthened thread evenly around and around an outer surface of said rubber bladder ball to overlap with each other until said bladder ball is embraced by a web layer of said strengthened thread to form a bladder, wherein said overlapped strengthened thread is adhered with each other and to said outer surface of said bladder ball;

(d) heating said bladder in a mold until said strengthened thread is hardened to form said web layer which is permanently and rigidly united with said outer surface of said bladder ball integrally;

(e) cutting a ball cover material into a predetermined number of panels in predetermined shape;

(f) sewing said panels edge to edge together by a sewing machine to form a ball cover which has a valve hole provided thereon, wherein a section of said panels are not sewn together to form an inlet opening;

(g) heating said ball cover and turn said ball cover right side out;

(h) inserting said strengthened bladder into said ball cover through said inlet opening;

(i) aligning and gluing said valve stem of said bladder with said valve hole of said ball cover;

(j) semi-inflating said bladder to make sure that said bladder is propped against said ball cover;

(k) hand sewing said inlet opening of said ball cover together to form the sportsball; and (l) fully inflating said sportsball to more than a standard pressure within a shaping mold to ensure a permanent structure and shape of said bladder and said ball cover.

2. A manufacturing method of a sportsball, as recited in claim 1, after step (c), further comprising an additional step of adhering a rubber pad having a same weight of said valve stem integrally to an end, which is opposite to said valve stem, of said bladder in order to symmetrically balance said bladder.

3. A manufacturing method of a sportsball, as recited in claim 1, in which said strengthened thread is a nylon thread.

4. A manufacturing method of a sportsball, as recited in claim 2, in which said strengthened thread is a nylon thread.

5. A manufacturing method of a sportsball, as recited in claim 1, in which each of said panels of said ball cover (are) is made of thin leather which has a pad layer adhered underneath.

6. A manufacturing method of a sportsball, as recited in claim 2, in which each of said panels of said ball cover (are) is made of thin leather which has a pad layer adhered underneath.

7. A manufacturing method of a sportsball, as recited in claim 1, in which said panels of said ball cover are made of synthetic leather.

8. A manufacturing method of a sportsball, as recited in claim 7, in which said panels of said ball cover are made of foaming polyurethane.

9. A manufacturing method of a sportsball, as recited in claim 7, in which said panels of said ball cover are made of foaming polyvinyl chloride.

* * * * *